US006719676B1

(12) United States Patent
Hsu

(10) Patent No.: US 6,719,676 B1
(45) Date of Patent: Apr. 13, 2004

(54) INFLATABLE ELASTIC EXERCISING DEVICE

(76) Inventor: Cheng-Hsiung Hsu, No. 29-18, Kou-Chien Lane, Kou-Chien Li, Lu-Kang Town, Changhua Hsien (TW)

( * ) Notice: Subject to any disclaimer, the term of this patent is extended or adjusted under 35 U.S.C. 154(b) by 0 days.

(21) Appl. No.: 10/436,287

(22) Filed: May 13, 2003

(51) Int. Cl.[7] ..... A63B 21/02

(52) U.S. Cl. ..... 482/121; 482/146; 482/147; 482/121; 482/126; 446/220

(58) Field of Search ..... 482/146, 147, 482/121–130, 126, 148, 907, 90–8, 79, 77, 34; 446/220; 273/58 R, 458; 473/52; 472/116, 134

(56) References Cited

U.S. PATENT DOCUMENTS 6,551,225 B1 * 4/2003 Romero ..... 482/146

6,575,885 B1 * 6/2003 Weck et al. ..... 482/147

* cited by examiner

*Primary Examiner*—Nicholas D. Lucchesi
*Assistant Examiner*—L Amerson
(74) *Attorney, Agent, or Firm*—Troxell Law Office PLLC

(57) ABSTRACT

An inflatable elastic exercising device includes a deflatable collapsible elastic body and a base seat composed of assembled outer frames and reinforcing boards. The elastic body is formed with a fixing flange. The thickness of the fixing flange plus the thickness of the reinforcing board is just the height of a restricting channel of the outer frame, so that the reinforcing boards and the elastic body can be firmly fixed and enclosed by the outer frames. A user can stably and safely stand on it for doing balance exercise. After the elastic body is deflated and collapsed and the reinforcing boards and the outer frames are disassembled and stacked, it can be stored in a narrow space and conveniently transported.

3 Claims, 7 Drawing Sheets

INFLATABLE ELASTIC EXERCISING DEVICE

BACKGROUND OF THE INVENTION

The present invention is related to an inflatable elastic exercising device composed of an elastic body, outer frames and reinforcing boards. The elastic body is deflatable and collapsible and the outer frames and reinforcing boards can be disassembled. After disassembled, the exercising body can be stored in a narrow space and conveniently transferred. In addition, the balance exercise can be stably and safely performed.

It is known that balance exercise can strengthen muscles of whole body of a user and enhance the energy and shape the curve of the body of the user. FIG. 1 shows an existent balance exerciser including a main envelope body 10, a base seat 14 and an annular fixing member 15.

The main envelope body 10 has a dome-shaped upper face. The outer circumference with maximum diameter is upward bent to form an annular hook section 11. The inner circumference of the bottom of the main envelope body 10 is inward recessed to form an annular insertion section 12. The center of the bottom of the main envelope body 10 is formed with a vent 13.

The base seat 14 is laid under the main envelope body 10. The base seat 14 has an upright annular support section 141 near the vent 13 of the main envelope body 10 for supporting the same. The outer circumference of the base seat 14 has an upward outward extending outer flange 142 inserted in the annular insertion section 12. In addition, a support rim 143 outward extends from the outer circumference of the annular support section 141. The bottom of the support rim 143 is fixable on any face. The top of the support rim 143 abuts against and supports the bottoms of the annular hook section 11 and the annular insertion section 12.

The annular fixing member 15 is annularly disposed around the main envelope body 10 to enclose the annular hook section 11 and the support rim 143.

It is known that an ordinary person (no matter male or female) has a height within 160 to 180 cm. That is, the conventional balance exerciser should have a minimum diameter of about 1 meter for a user to stretch his/her limbs and balance the body. However, the balance exerciser with such a diameter will occupy much room. Therefore, it is inconvenient to store or transfer the balance exerciser.

SUMMARY OF THE INVENTION

It is therefore a primary object of the present invention to provide an inflatable elastic exercising device composed of a deflatable collapsible elastic body, outer frames and reinforcing boards that can be disassembled. After disassembled, collapsed and stacked, the exercising body can be stored in a narrow space and conveniently transferred.

It is a further object of the present invention to provide the above inflatable elastic exercising device in which the elastic body has a top face for a user to stand thereon to do balance exercise. The balance exercise can be stably and safely performed.

It is still a further object of the present invention to provide the above inflatable elastic exercising device further including rope sections for varying the balance exercise and ensuring the safety in the balance exercise.

The present invention can be best understood through the following description and accompanying drawings wherein:

DETAILED DESCRIPTION OF THE PREFERRED EMBODIMENTS

Figure 1:
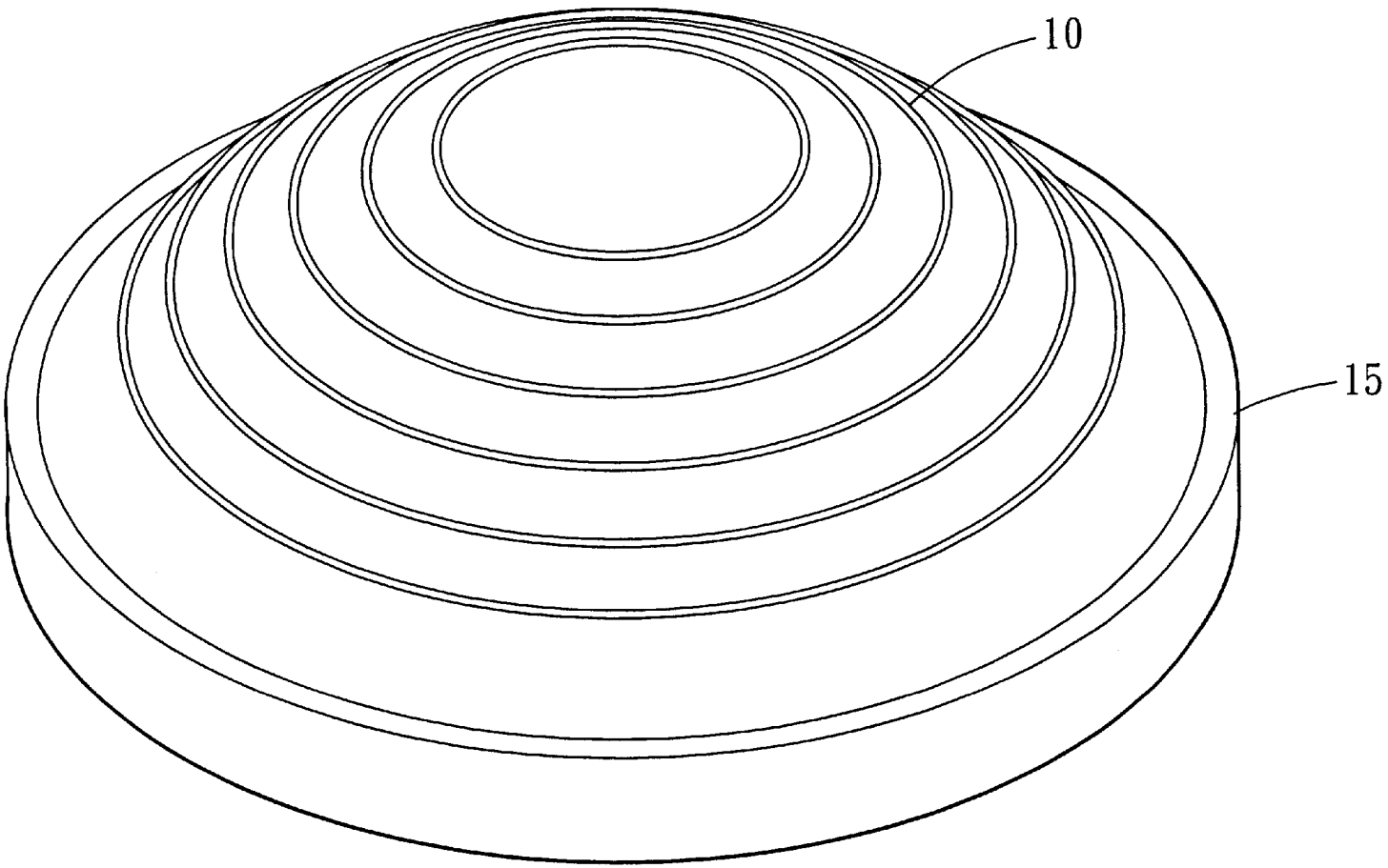
FIG. 1 (PRIOR ART)
FIG. 1 is a perspective view of a conventional balance exerciser.
Figure 2:
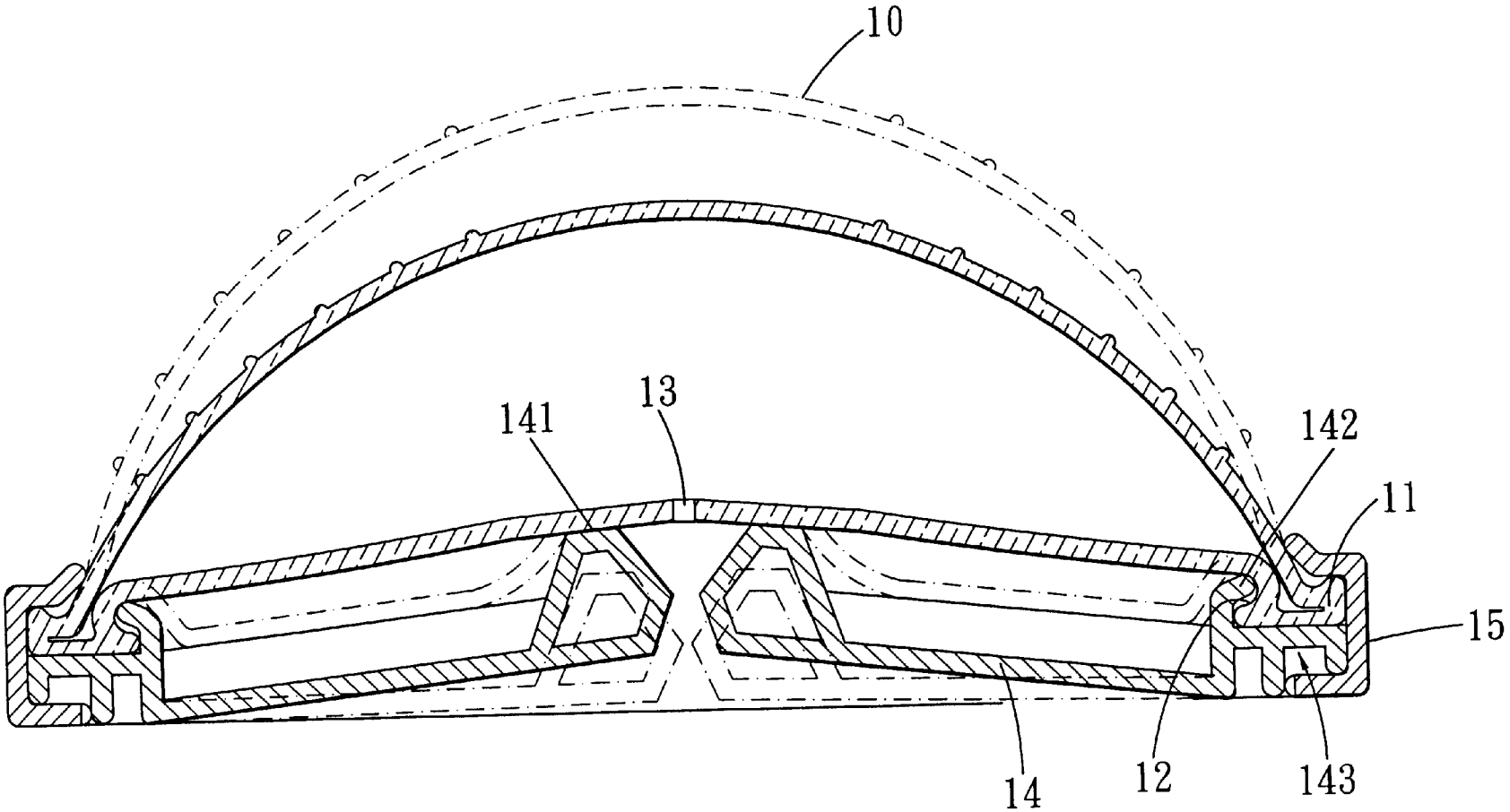
FIG. 2 (PRIOR ART)
FIG. 2 is a side sectional view of the conventional balance exerciser.
Figure 3:
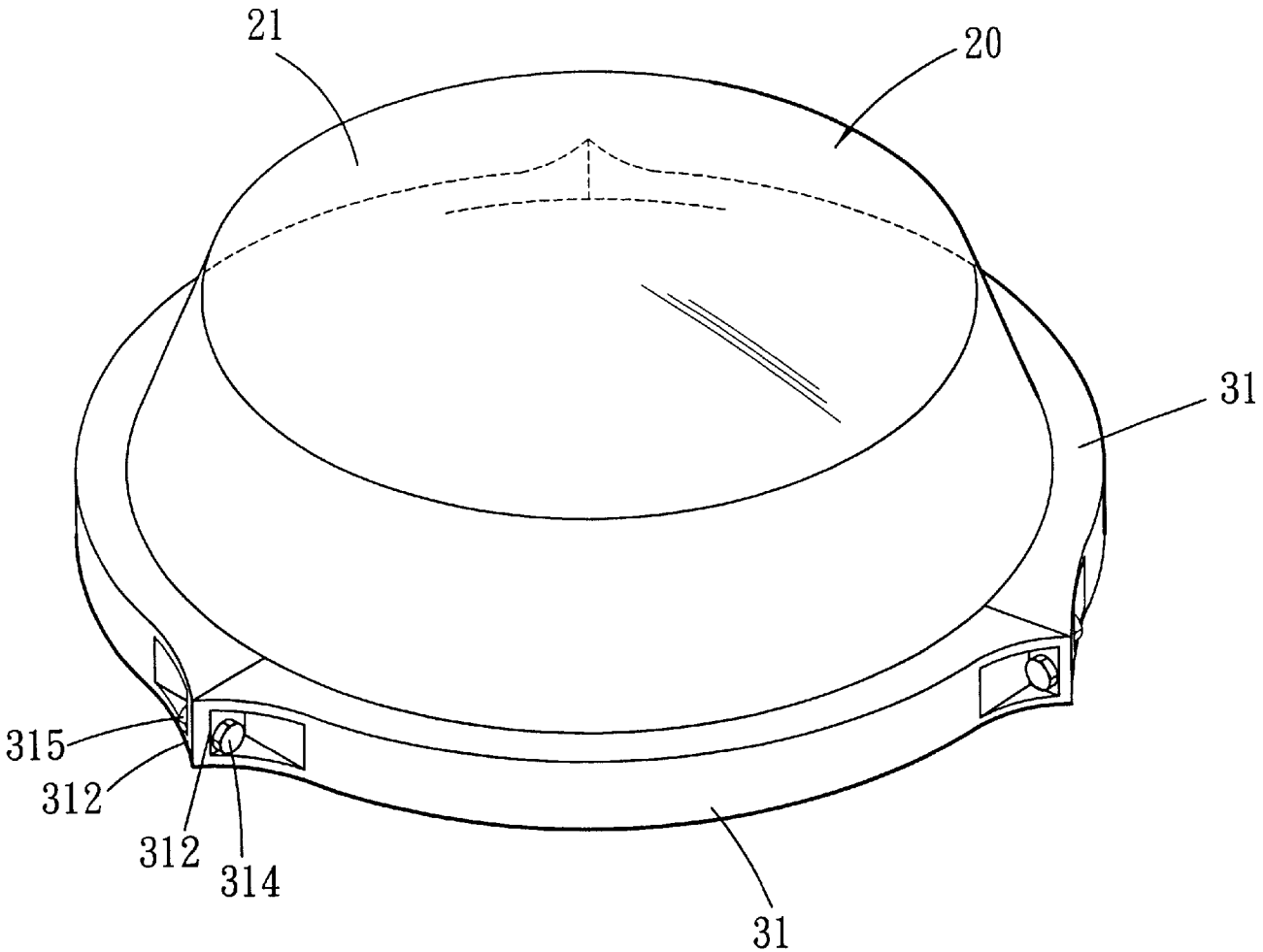
FIG. 3 is a perspective assembled view of the present invention.
Figure 4:
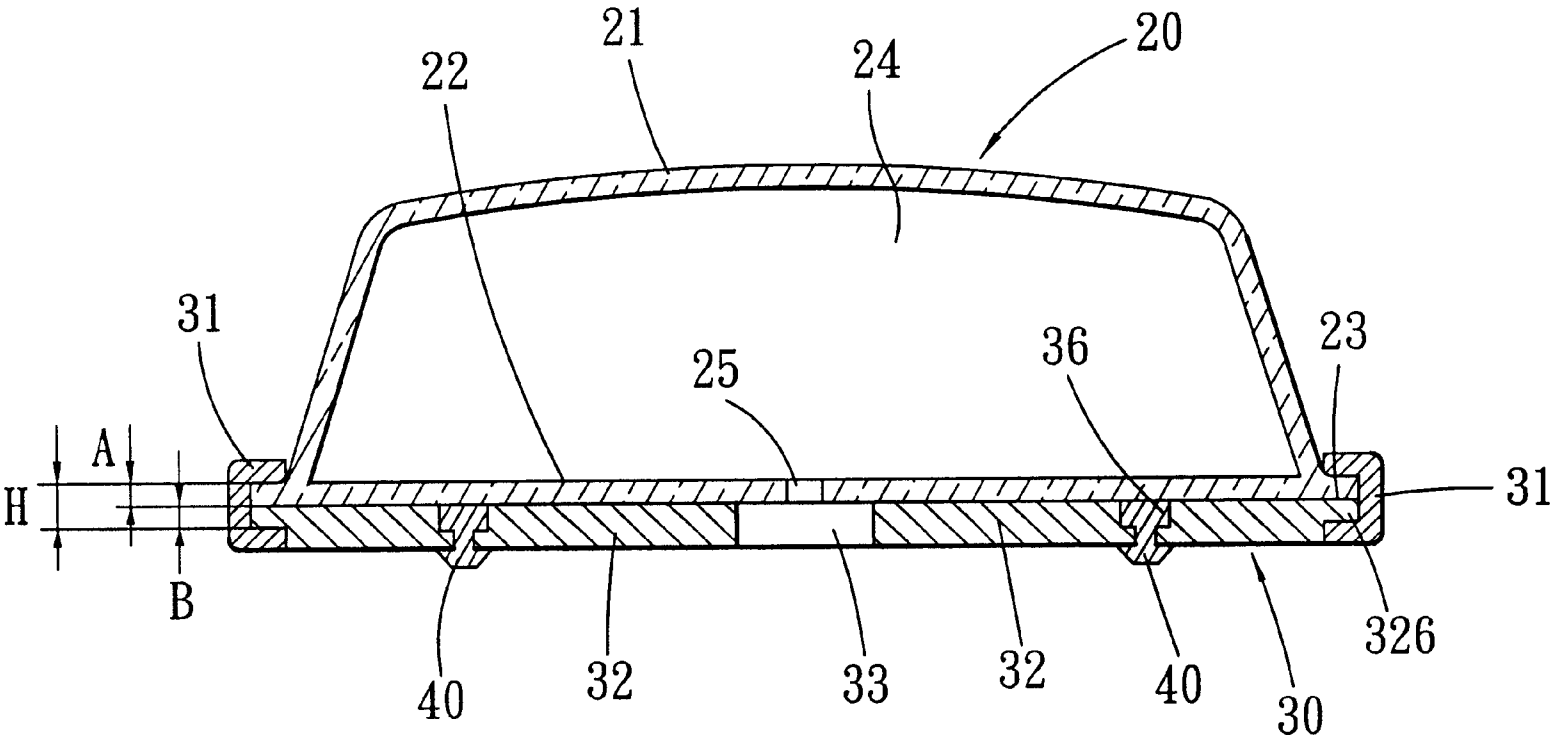
FIG. 4 is a side sectional view of the present invention.

Please refer to FIGS. 3 and 4. The inflatable elastic exercising device of the present invention can be disassembled and collapsed. The inflatable elastic exercising device includes an elastic body 20 and a base seat 30.

The elastic body 20 is a substantially inflatable dome body. The elastic body 20 has a top face 21 for supporting a user and a bottom face 22 for enhancing the stability of the elastic body 20. In addition, the outer circumference of the elastic body 20 is formed with a fixing flange 23 having a thickness A. The elastic body 20 defines therein a receiving section 24. The center of the bottom of the elastic body 20 is formed with a vent 25 for inflating or deflating the elastic body 20. In normal state, the vent 25 is sealed.

Figure 5:
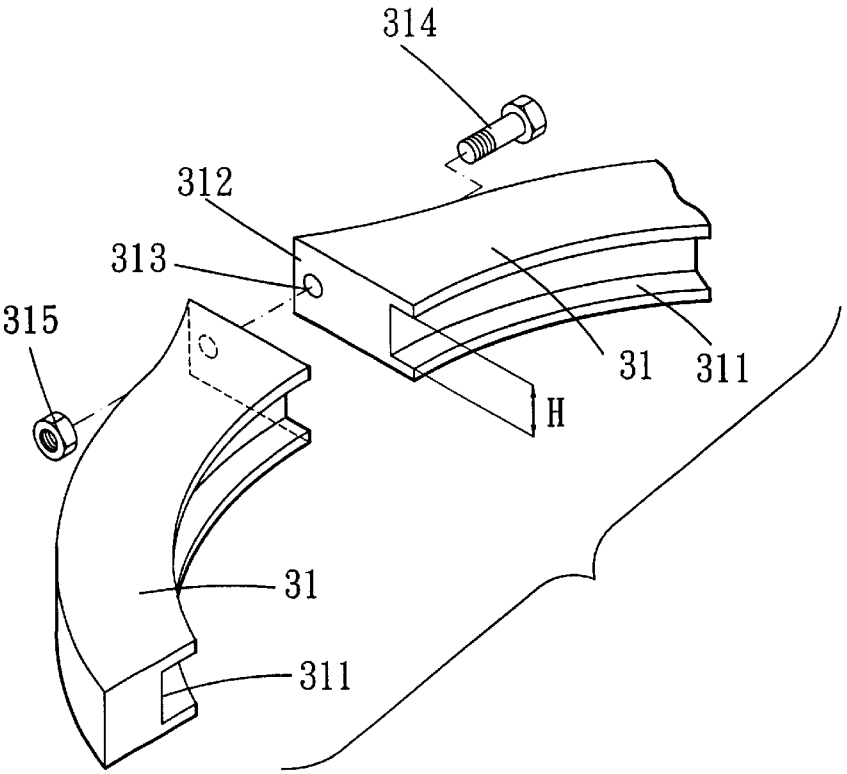
FIG. 5 is a perspective exploded view of a part of the present invention.

The base seat 30 includes multiple outer frames 31 (there are, three in this embodiment) which can be assembled into an annular structure (referring to FIG. 5). Each outer frame 31 is substantially an arched member. The inner circumference of the outer frame 31 is recessed and formed with a restricting channel 311. The restricting channel 311 has a height H. Two ends of the outer frame 31 slightly outward extend to form two abutting sections 312. The abutting section 312 is formed with at least one fixing hole 313 for a fixing member 314 to pass therethrough. The fixing member 314 and a fastening member 315 cooperatively lock two opposite abutting sections 312 so as to connect two adjacent outer frames 31 together.

Figure 6:
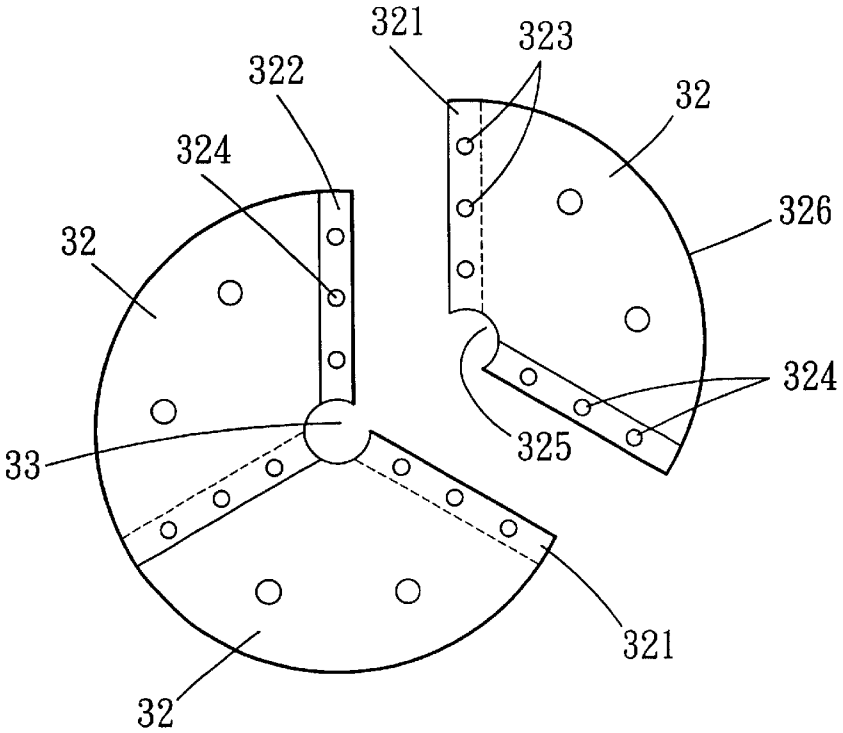
FIG. 6 is a top exploded view of a part of the present invention.
Figure 7:
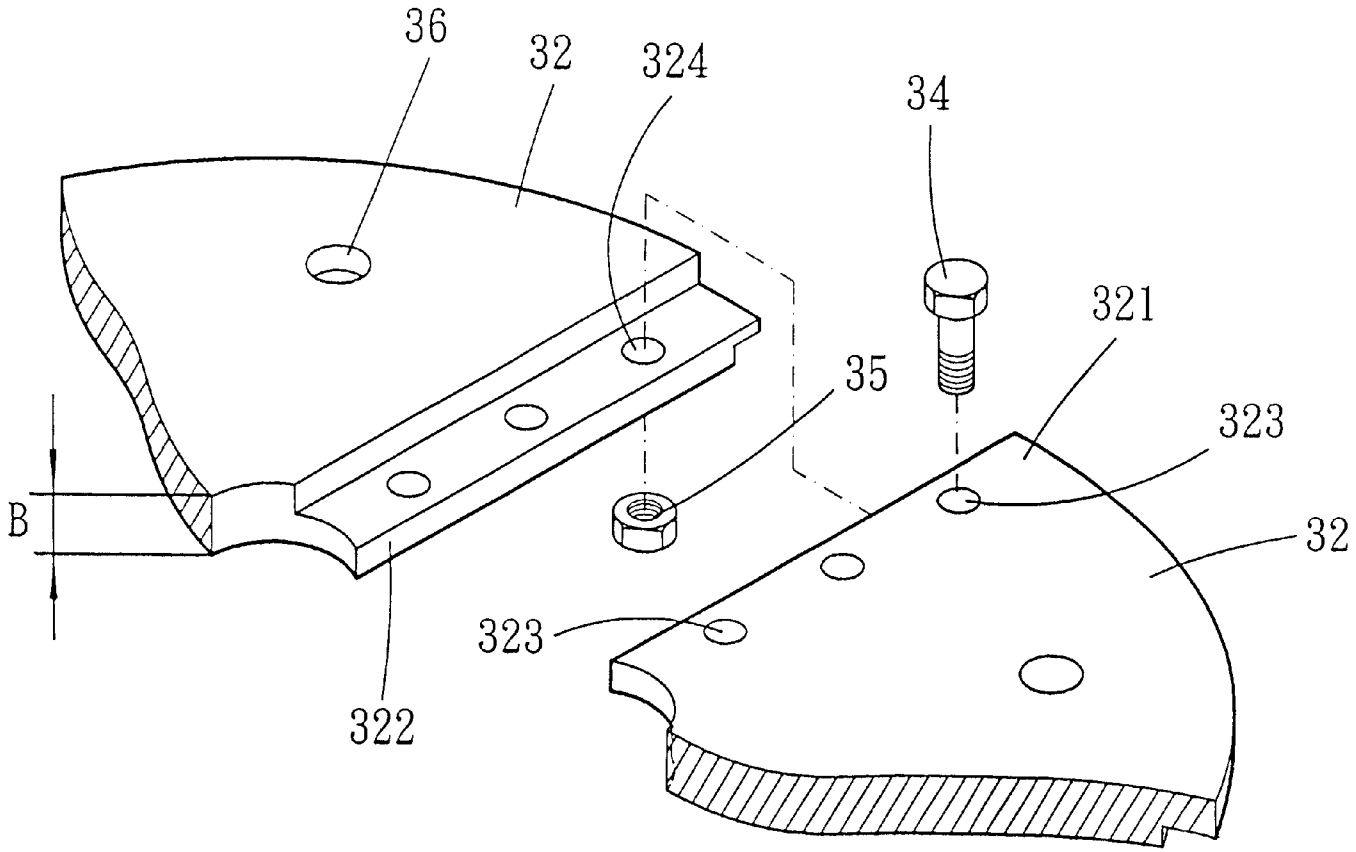
FIG. 7 is a perspective exploded view of a part of the present invention.

The base seat 30 further includes multiple reinforcing boards 32 (there are three in this embodiment) which are substantially sector members (referring to FIG. 6). The reinforcing board 32 has a thickness B. The reinforcing boards 32 can be assembled into a circular board. A lateral side of each reinforcing board 32 has a horizontally projecting upper connecting plate 321, while the other lateral side thereof has a projecting lower supporting plate 322 corresponding to the upper connecting plate 321. The upper connecting plate 321 can be overlaid on the lower supporting plate 322 and connected therewith to fix the reinforcing boards 322 with each other. The upper connecting plate's 321 and the lower supporting plates 322 can be switched to interconnect the reinforcing boards 32. The upper connecting plate 321 is formed with at least one upper hole 323 and the lower supporting plate 322 is formed with at least one lower hole 324. A fixing member is passed through the upper hole 323 and the lower hole 324 and fixed with a fastening member 35 to interconnect the reinforcing boards 32. Referring to FIG. 7, in this embodiment, there are three upper holes and three lower holes.

In addition, the inner side of the reinforcing board 32 is formed with an inner arch 325. When the reinforcing boards 32 are assembled, the inner arches 325 together define a small circle 33 at the center, whereby the air can go from the small circle 33 into the vent 25. The thickness A of the fixing flange 23 plus the thickness B of the outer circumference 326 of the reinforcing board 32 is approximately the height H of the restricting channel 311. Accordingly, the reinforcing boards 32 can be firmly assembled to have a reliable rigidity and structural strength. In addition, the reinforcing board 32 is formed with at least one longitudinal stepped hole 36 having an enlarged end facing upward (referring to FIGS. 4 and 6). In this embodiment, there are two stepped holes 36. A slipproof member 40 is inlaid in the stepped hole 36 for achieving a slipproof effect for the reinforcing board 32.

Figure 8:
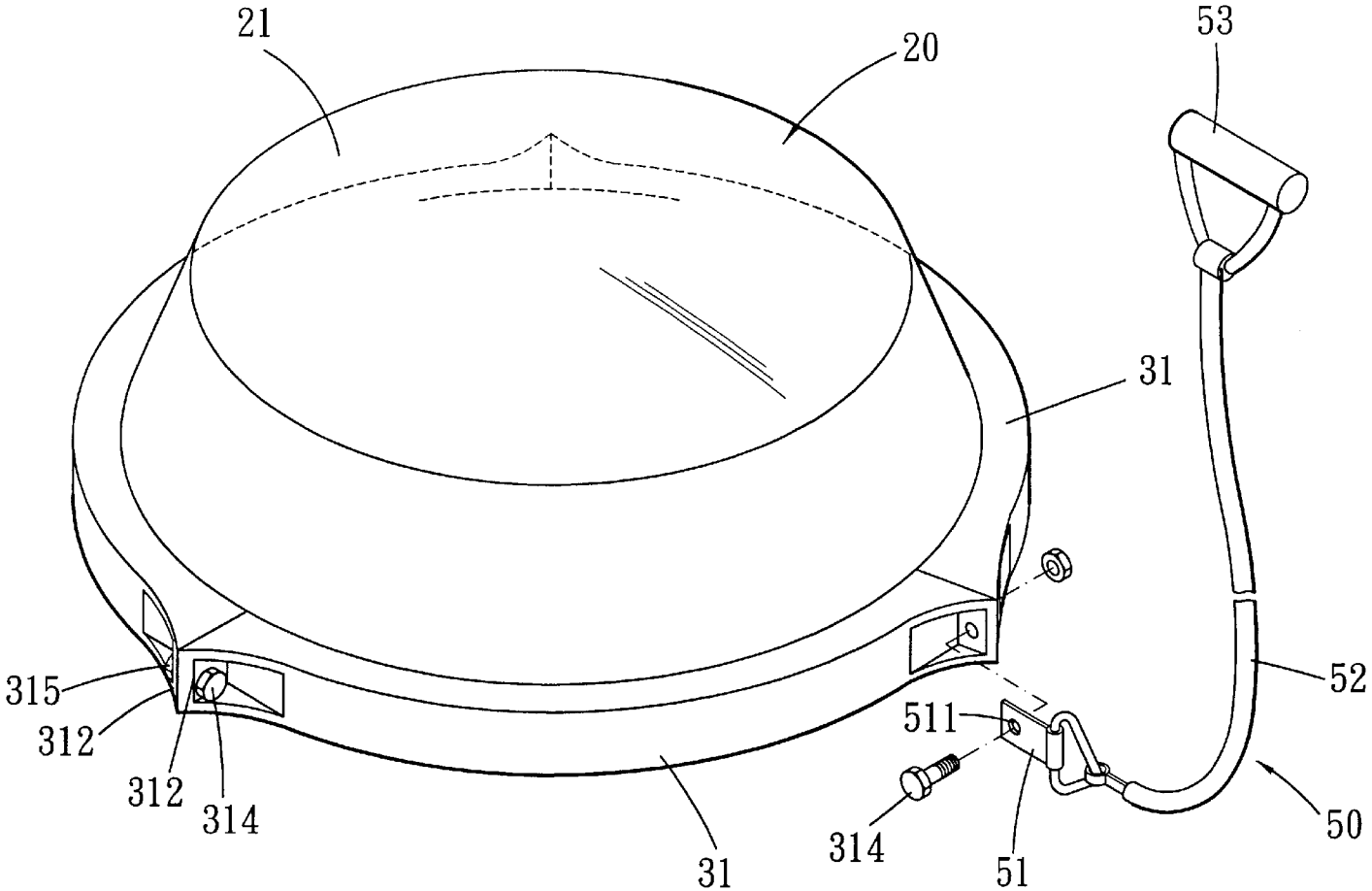
FIG. 8 is a perspective view of another embodiment of the present invention.

Referring to FIG. 8, practically, the present invention further includes one or more externally connected rope section 50 cooperating with the elastic body 20. One end of the rope section 50 has at least one connecting member 51 formed with a through hole 511 for a fixing member 314 to pass therethrough. The rope section 50 has a pull rope 52 (such as an elastic rope). The free end of the pull rope 52 is equipped with a handle 53. By means of the rope section 50, the balance exercise can be varied and the safety can be enhanced.

The present invention has the following advantages:

1. The present invention can be easily transported and stored. The elastic body 20 is deflatable and collapsible. After collapsed, the elastic body 20 has a thin pattern. The outer frames 31 and the reinforcing boards 32 can be disassembled. Therefore, after disassembled, collapsed and stacked, the volume of the present invention is minimized. Therefore, the present invention can be stored in a narrow space and conveniently transferred.
2. The present invention enables a user to comfortably and safely stand thereon in balance. A user can stand on the substantially plane top face 21 of the elastic body 20 for balance exercise. When the user stands on the elastic body 20, the top face 21 is immediately resiliently compressed to prevent the user from skidding and thus ensure safety. Therefore, the user can comfortably and stably stand on the elastic body for balance exercise. The bottom face of the elastic body is expanded and flattened so that the elastic body can be stably and firmly rested to ensure safety in the balance exercise.
3. The present invention further includes one or more externally connected rope section 50 cooperating with the elastic body 20. In balance exercise, by means of the rope section 50, the user can vary the type of balance exercise. Also, the rope section helps in ensuring the safety in the balance exercise.

The above embodiments are only used to illustrate the present invention, not intended to limit the scope thereof. Many modifications of the above embodiments can be made without departing from the spirit of the present invention.

What is claimed is:

1. An inflatable elastic exercising device comprising:

an elastic body having a top face, an outer circumference of the elastic body being formed with a fixing flange with a certain thickness, the elastic body defining therein a receiving section for containing air, a bottom of the elastic body being formed with a vent; and a base seat including:

(A) multiple outer frames that can be assembled into an annular structure, an inner circumference of each outer frame being recessed and formed with a restricting channel with a certain height, two ends of the outer frame slightly outward extending to form two abutting sections for connecting with adjacent outer frames; and (B) multiple reinforcing boards which can be assembled into a circular board, a lateral side of each reinforcing board having a horizontally projecting upper connecting plate, while the other lateral side thereof having a projecting lower supporting plate corresponding to the upper connecting plate, whereby the upper connecting plate can be overlaid on the lower supporting plate of an adjacent reinforcing board and connected therewith to fix the reinforcing boards with each other, inner side of the reinforcing board being formed with an inner arch, the outer circumference of the reinforcing board having a certain thickness, whereby when the reinforcing boards are assembled, the inner arches together define a small circle at the center to communicate with the vent, the thickness of the fixing flange plus the thickness of the outer circumference of the reinforcing board substantially being the height of the restricting channel of the outer frame, whereby the reinforcing boards and the elastic body can be firmly enclosed by the outer frames.

2. The inflatable elastic exercising device as claimed in claim 1, wherein:

the abutting section of the outer frame is formed with multiple transverse fixing through holes, whereby a fixing member can pass through each fixing hole and lock with a fastening member to cooperatively connect the adjacent outer frames together;

the upper connecting plate of the reinforcing board is formed with at least one upper hole and the lower supporting plate is formed with at least one lower hole, whereby a fixing member longitudinally passes through the upper hole and the lower hole and fixed with a fastening member to interconnect the reinforcing boards; and each reinforcing board is formed with at least one stepped hole, a slipproof member being inlaid in the stepped hole for achieving a slipproof effect.

3. The inflatable elastic exercising device as claimed in claim 1, further comprising at least one externally connected rope section cooperating with the elastic body, the rope section having at least one connecting member formed with a through hole for a fixing member to pass therethrough for connecting with the abutting section, the rope section having an elongated pull rope, a free end of the pull rope being equipped with a handle for a user to pull.

* * * * *